US007435153B1

(12) United States Patent
Sodec, Jr.

(10) Patent No.: US 7,435,153 B1
(45) Date of Patent: Oct. 14, 2008

(54) ARTICULATING COMPANION DOLL

(76) Inventor: John Sodec, Jr., P.O. Box 4392 Lower Rd., Fort Walton Beach, FL (US) 32549-4392

( * ) Notice: Subject to any disclaimer, the term of this patent is extended or adjusted under 35 U.S.C. 154(b) by 313 days.

(21) Appl. No.: 11/495,210

(22) Filed: Jul. 31, 2006

(51) Int. Cl.
*A63H 3/00* (2006.01)
*A63H 3/20* (2006.01)

(52) U.S. Cl. ..... 446/295; 446/353

(58) Field of Classification Search ..... 446/295, 446/330, 353; 600/38
See application file for complete search history.

(56) References Cited

U.S. PATENT DOCUMENTS 1,896,663 A 2/1933 Collins
2,774,184 A 12/1956 Hefferan et al.
4,060,932 A 12/1977 Leto et al.
4,204,110 A * 5/1980 Smit et al. ..... 392/443
4,209,939 A 7/1980 Pittala
5,394,766 A * 3/1995 Johnson et al. ..... 74/490.01
5,466,235 A 11/1995 Shubin, Sr.
6,022,263 A * 2/2000 Liu et al. ..... 446/379
6,695,770 B1 2/2004 Choy et al.
2004/0122287 A1 6/2004 Minigh
2005/0027162 A1 2/2005 Paled

* cited by examiner

*Primary Examiner*—John Ricci
(74) *Attorney, Agent, or Firm*—Peter Loffler

(57) ABSTRACT

A companion doll for use in either a patrol car to give the illusion of the presence of an additional officer or for home companion use has a human-like appearance and has several components that articulate including a head that turns, upper and lower arms that raise and lower, and hands that open and close. Motion of these components can be random or can be in response to received external stimuli wherein the doll uses motion and light sensors to detect this stimuli. A closed loop heated water pumping system within the doll warms exterior surface of the doll to give the doll further human-like qualities.

17 Claims, 5 Drawing Sheets

ARTICULATING COMPANION DOLL

BACKGROUND OF THE INVENTION

1. Field of the Invention

The present invention relates to a life-sized companion doll that gives the impression that more humans are in a vehicle that is actually the case or that can otherwise provide companionship.

2. Background of the Prior Art

Policing is a tough job requiring police officers to deal with some of the toughest elements of society. Murderers, rapists, drug dealers, and thieves are on the resumes of some of the elements that an officer must deal with on a daily basis. Not only must officers deal with the aftermath of the damage caused by criminals, investigate the crimes, and catch the perpetrators, the police must be ever vigilant for their own safety from the criminal element. A portion of the criminal population is not only determined to commit crimes, but also to specifically cause harm to the police. Some criminals are bent on hurting a particular cop for specific actions of the cop while others seek to hurt any police officer with whom they come in contact either for revenge or out of shear sociopathic instinct.

One situation where an officer may be particularly vulnerable is when the officer parks his or her patrol car, often at night, in order to catch up on paperwork, have a meal, sit and observe the area, or simply to take a well deserved break. Such situations are ideal for a bad guy to try and inflict harm on an officer. The officer is alone, stopped, and possibly with his or her guard down somewhat. If the bad guy strikes suddenly, he may gain the upper hand before the officer has time to react. Even if the officer can get to the radio, backup may be several minutes away, enough time for the bad actor to do the harm and escape.

To combat this problem, many police jurisdictions partner up their patrol officers. A single bad guy does not want to attack two officers. Even if the criminal is able to gain the upper hand on one officer, the other will call in for help and also take care of the bad guy, possibly upon less than pleasant terms. While there is safety in numbers, many jurisdictions simply lack the manpower and/or the resources to double up their patrol officers and must send out each cop alone and rely on backup for safety. However, to help protect their officers from ambush, some jurisdictions have resorted to placing a mannequin or other similar human form into the passenger seat of the patrol car in order to give the appearance of two officers being present in the vehicle. If a criminal thinks that two officers are present, the criminal will move on. The problem with this method is that the mannequin is entirely static and if a person observes the mannequin for some length of time, as a criminal might in planning an ambush, the mannequin will be discovered for what it is—non-human.

Accordingly, there exists a need in the art for a device that helps protect a single patrol officer from someone out to intentionally harm an officer by giving the illusion that more than one officer populates a patrol car. Such a device must be human-like in appearance even if observed for some length of time. Ideally such a device can also provide companionship to an officer or even a non-officer at times other than at work and at locations other than a patrol car, such as a bedroom. The device should be of relatively simple design and construction and be relatively easy to use and maintain.

SUMMARY OF THE INVENTION

The articulating companion doll of the present invention addresses the aforementioned needs in the art by providing a human-like doll that gives the illusion that more than one officer populates a patrol car in order to help protect a single patrol officer from someone out to intentionally harm an officer via ambush. The articulating companion doll is human-like in appearance even if observed for some length of time. The articulating companion doll also offers companionship to a user in and out of work and in and out of a car, such as in a bedroom. The present invention is of relatively simple design and construction and is relatively easy to use and maintain.

The articulating companion doll of the present invention is comprised of a base member onto which a base bar is attached. A standard extends upwardly from the base bar while a cross bar is attached to the top of the standard. A first bar is rotatably attached to a medial point of the cross bar while a first shell, in the representation of a human head, is attached to and covers the first bar. A second bar is rotatably attached to an end of the cross bar while a third bar is rotatably attached to the second bar. A reservoir is attached to the base member and has a pump fluid flow connected thereto. A second shell, in the representation of at least a portion of a human body, covers the base bar, the standard, the cross bar, the second bar, the third bar, the reservoir, and the pump such that the second shell attaches to the first shell and to the base member and such that the cross bar is received within a representation of shoulders of the human body of the second shell, the second bar is received within a representation of an upper arm of the human body of the second shell and the third bar is received within a representation of a lower arm of the human body of the second shell. A tube is fluid flow connected with the pump and with the reservoir and passes through the second shell. The head, the upper arm and the lower arm are each able to articulate. The pump draws fluid from the reservoir and pumps the fluid through the tube and thereafter the fluid returns to the reservoir. A first motion sensor is disposed within a representation of an eye of the head of the first shell such that the head articulates in response to a motion stimuli received by the first motion sensor. A second motion sensor is disposed within the head of the first shell proximate a representation of an ear such that the head also articulates in response to a motion stimuli received by the second motion sensor. A light sensor is also disposed within the head of the first shell proximate the representation of the ear such that the head also articulates in response to a light stimuli received by the light sensor. A voice box may be disposed within the first shell such that the voice box produces a sound whenever the head articulates. A first sub-frame is attached to the third bar while a second sub-frame is rotatably attached to the first sub-frame and is capable of articulating with respect to the first sub-frame. A heater element is disposed within the reservoir in order to heat the fluid held within the reservoir. A sight glass is disposed within the reservoir and protrudes through the second shell.

BRIEF DESCRIPTION OF THE DRAWINGS

Similar reference numerals refer to similar parts throughout the several views of the drawings.

DESCRIPTION OF THE PREFERRED EMBODIMENT

Figure 1:
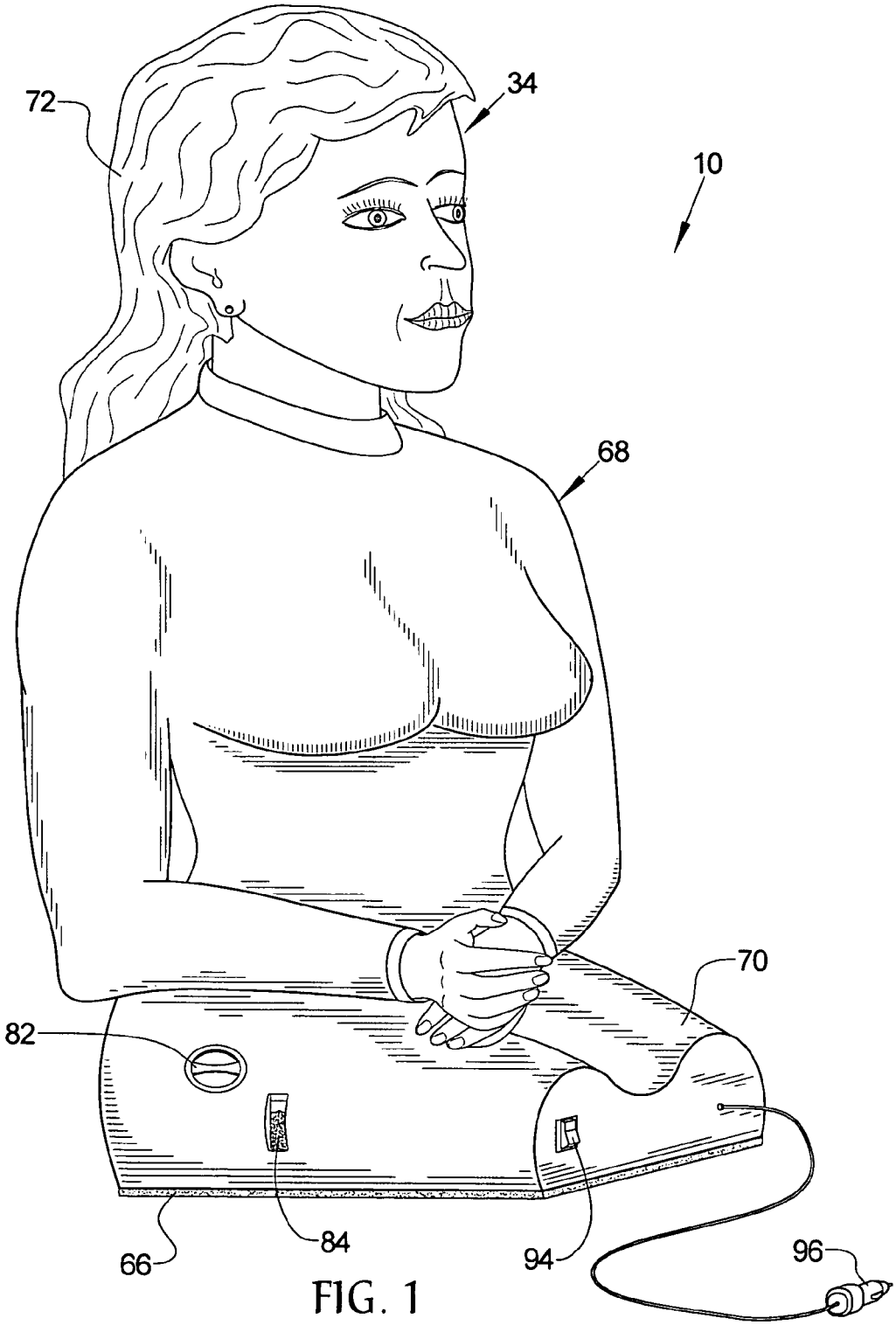
FIG. 1 is a perspective view of the articulating companion doll of the present invention.
Figure 2:
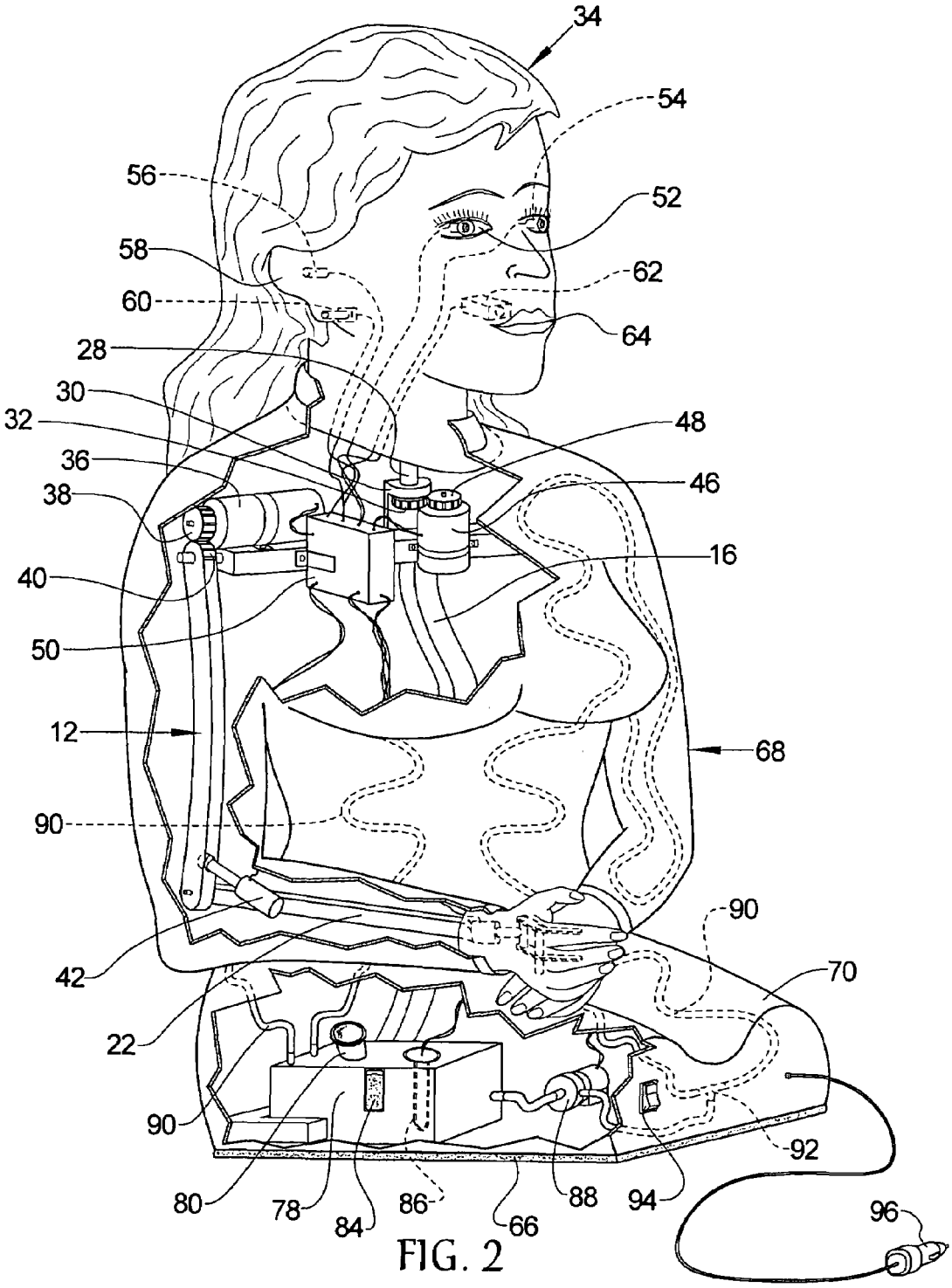
FIG. 2 is a perspective view of the articulating companion doll of FIG. 1, partially cut away, illustrating the internal workings.
Figure 3:
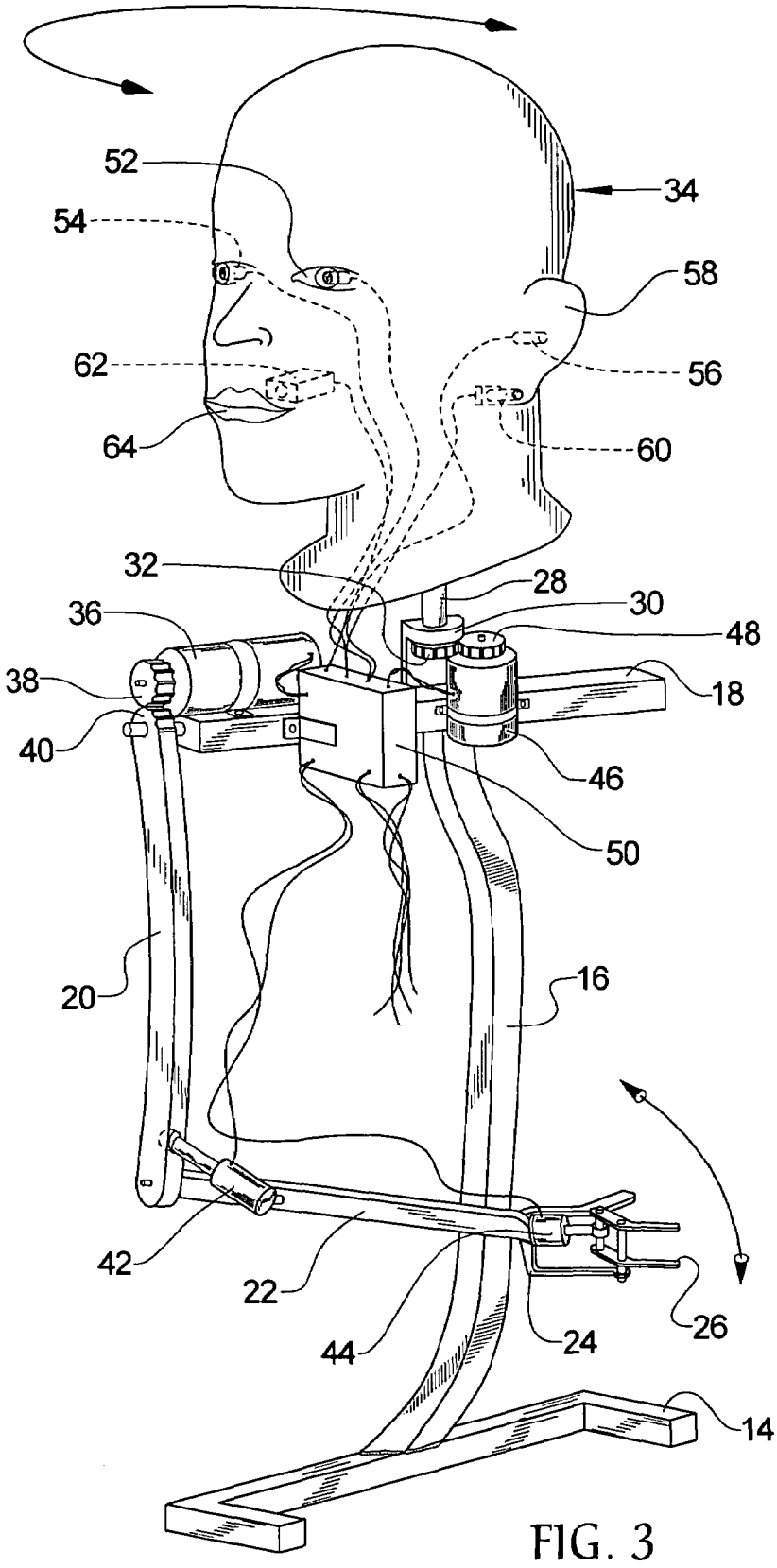
FIG. 3 is a perspective view of the articulating companion doll of FIG. 1 illustrating the internal framework and articulation components.

Referring now to the drawings, it is seen that the articulating companion doll of the present invention, generally denoted by reference numeral 10, is comprised of an articulating internal framework 12. As seen, the framework 12 has a base frame bar 14, a torso standard 16, and an upper shoulder cross bar 18. An upper arm bar 20 is pivotally attached to the right side of the shoulder cross bar 18, while a lower arm bar 22 is pivotally attached to the upper arm bar 20. A hand sub-frame 24 is attached to the opposing end of lower arm bar 22 while a finger sub-frame 26 is pivotally attached to the hand sub-frame 24. A neck bar 28 extends upwardly from the shoulder cross bar 18 and is attached thereto via a drive gear housing 30 that has a driven gear 32 thereon, the drive gear housing 30 allowing the neck bar 28 to rotate with respect to the shoulder cross bar 18. A shell 34 in the representation of a human head sits atop the neck bar 28. As seen, an arm rotation first motor 36 is attached to the shoulder cross bar 18 and has a first drive gear 38 that the first motor 36 rotates, this gear 38 meshing with gearing 40 located on the end of the upper arm bar 20 such that rotation of the first gear 38 in response to operation of the first motor 36, causes the upper arm bar 20 to rotate with respect to the shoulder cross bar 18. A first solenoid actuator 42 connects the upper arm bar 20 with the lower arm bar 22 such that articulation of the first solenoid actuator 42 causes the lower arm bar 22 to pivot with respect to the upper arm bar 20. A second solenoid actuator 44 connects the lower arm bar 22 with the finger sub-frame 26 such that articulation of the second solenoid actuator 44 causes the finger sub-frame 26 to pivot with respect to the hand sub-frame 24. If desired, the internal framework 12 may provide for a left arm framing subsystem, however, in countries wherein the driver of a vehicle sits on the left hand side of the vehicle, only the right side of the articulating companion doll 10 needs to articulate (in countries wherein the driver of the vehicle sits on the right hand side of the vehicle, the left side of the articulating companion doll 10 needs to articulate). A neck rotation second motor 46 has a second drive gear 48 thereon that this second motor 46 rotates, which second gear 48 meshes with the driven gear 32 of the drive gear housing 30 such that rotation of the second gear 48, in response to operation of the second motor 46, causes the neck bar 28 to rotate with respect to the shoulder cross bar 18.

A controller 50 is attached to an appropriate point on the framework 12 and is electrically connected to the first motor 36, the second motor 46, the first solenoid actuator 42, and the second solenoid actuator 44 in order to control these various components.

Located within the head 34 and positioned within one or both eyes 52 thereof, is one or more first motion sensors 54. Another motion sensor 56 is located within the head 34 proximate the right ear 58 thereof, as is a light sensor 60. An optional voice box 62 may be located within the head 34 proximate the mouth 64 thereof. The first motion sensors 54, the second motion sensor 56, the light sensor 60 and the voice box 62 are all electrically connected to the controller 50 in order to control these various components.

Figure 4:
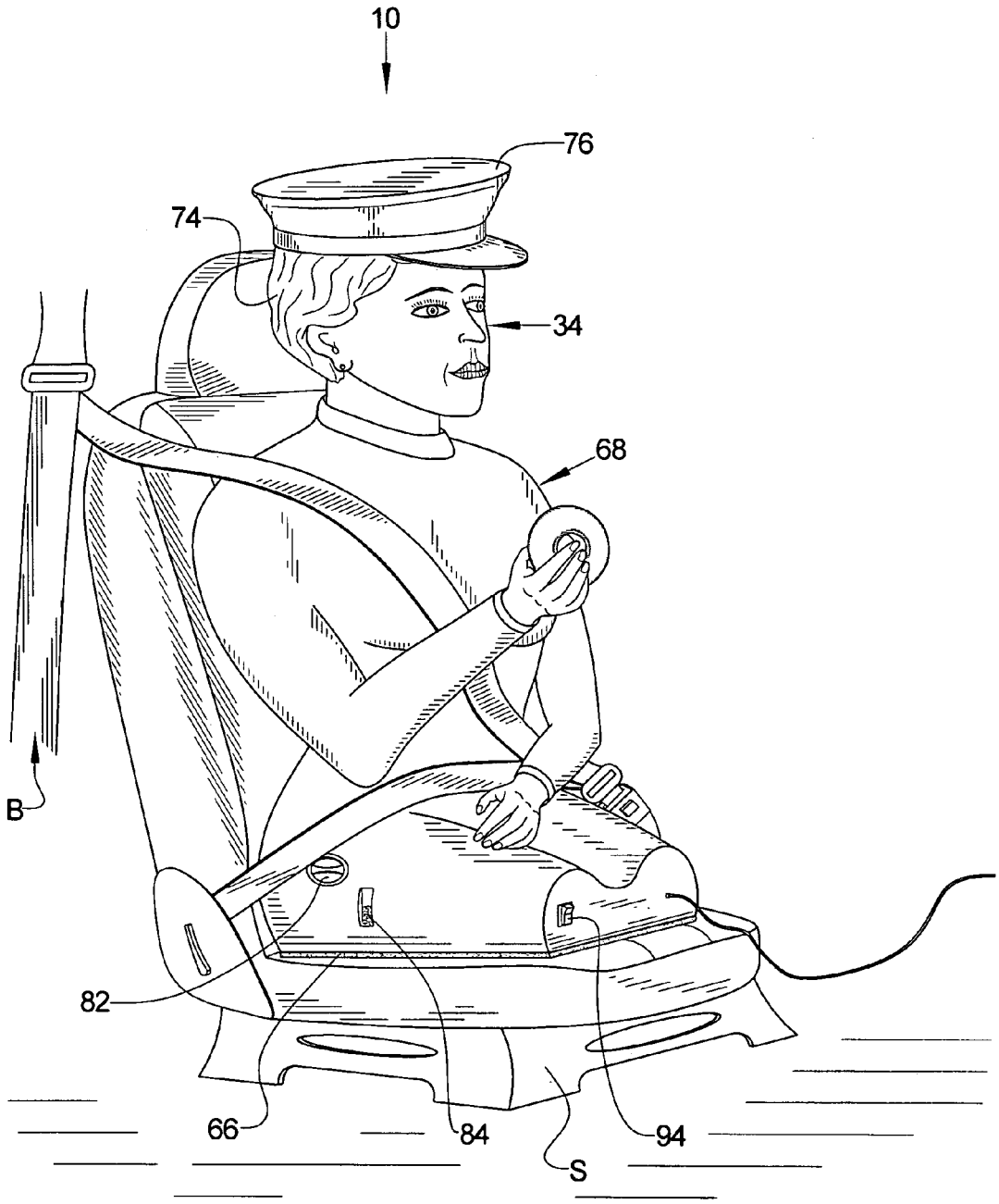
FIG. 4 is a perspective view of the articulating companion doll of FIG. 1 secured within a vehicle seat.

The base frame bar 14 is attached to a base member 66. Covering the framework 12 and its various components is a shell 68 in the representation of a human body, namely the upper portion and possibly a section of the thighs 70, although the entire body may be represented, the shell 68 attaching to the base member 66 and the first shell 34. The human body representation, which includes the shell 68 and the head 34, may be male or, as illustrated, female, may have long hair 72 or short hair 74, may be flat-chested or full-chested and may have any appropriate clothing such as the police officer's uniform 76 illustrated in FIG. 4. The outer surface of the of the human body shell 68 and head 34 is made from any appropriate material, such as rubber, silicone, etc., that approximates actual human skin and is appropriately colored so as to visually resemble human skin.

Located on the base member 66 is a fluid reservoir 78 that has a fill tube 80 that passes through the shell 68 and is accessible exterior of the shell 68. A cap 82 is removably attached to the fill tube 80. A sight glass 84 is located on the reservoir 78 and protrudes through the shell 68 so that the sight glass 84 is visible exterior of the shell 68. A heater element 86 is disposed within the reservoir 78. A pump 88 is fluid flow connected with the reservoir 78. One or more tubes 90 extend out from the pump 88 and terminate in the reservoir 78 so that the reservoir 78, the pump 88 and the tubes 90 form a closed fluid loop. If more than tube 90 is used, appropriate T-branches 92 are used for branching thereof. The tubes 90 are disposed within the shell 68 and are located proximate its outer surface. The pump 88 and the heater element 86 are electrically connected to the controller 50 in order to control these elements. A power and/or function switch 94 is located on the shell 68 and is electrically connected to the controller 50. A 12 volt plug 96 is provided and is electrically connected to the controller 50 for electrically powering the device 10. The articulated companion doll 10 can be powered by additional or alternate means, such as batteries, solar collectors, etc., (none illustrated).

In order to use the articulated companion doll 10 of the present invention, the reservoir 78 is filled with water. Appropriate clothing is placed upon the doll 10 and the doll 10 is placed into the passenger seat S of a vehicle such as a patrol car. The vehicle's seat belt B is used to strap the doll in appropriately. The doll 10 rests on its base 66 and has sufficient thigh 70 length so that the lap portion of the seat belt B appropriately buckles the doll 10 in place. The 12 volt plug 96 is plugged into a 12 volt accessory outlet (not illustrated) of the vehicle in order to provide electrical power to the articulated companion doll 10. The doll 10, by having a human like appearance, makes people think that the patrol car is populated by two officers not just one. In order to further give human-like appearance, the various articulatable components of the device 10, move either on a scheduled basis or based on specific external stimuli. For example, the doll 10 can be set to move one or more movable components every few seconds such as turning the head 34 every so often or moving the upper arm bar 20 or the lower arm bar 22. The movements can be randomly selected so that the head 34 may turn followed by a lower arm bar 22 raise, followed by another head 34 turn, etc. In addition, or alternately, the various articulating components can move based on the receipt of external stimuli. For example, if one of the first motion sensors 54 senses motion, a component can articulate, for example, the upper arm bar 20 raises. If the second motion sensor 56 senses motion or the light sensor 60 senses light, the head 34 can turn in the direction of the received stimuli. In this way, if someone is outside of the vehicle and the doll 10 senses this presence, the doll 10 "comes alive" and responds to the stimuli further giving the impression that the passenger is an actual police office. If the optional voice box 62 is used, the doll 10 can also speak in response to received stimuli or just randomly in order to keep the driver company. The sound produced by the voice box 62 can be prerecorded at the factory or can be recordable via an appropriate microphone (not illustrated), for example, a wife may record some message for her police officer husband and the doll 10 plays these recorded messages. To further help keep the officer company, the water within the reservoir 78 is heated via the heater element 86 and pumped through the tubes 90 via the pump 88 in order to keep the exterior "skin" of the doll 10 warm and more humanlike. The controller controls operation of all of the various components of the device 10.

Figure 5:
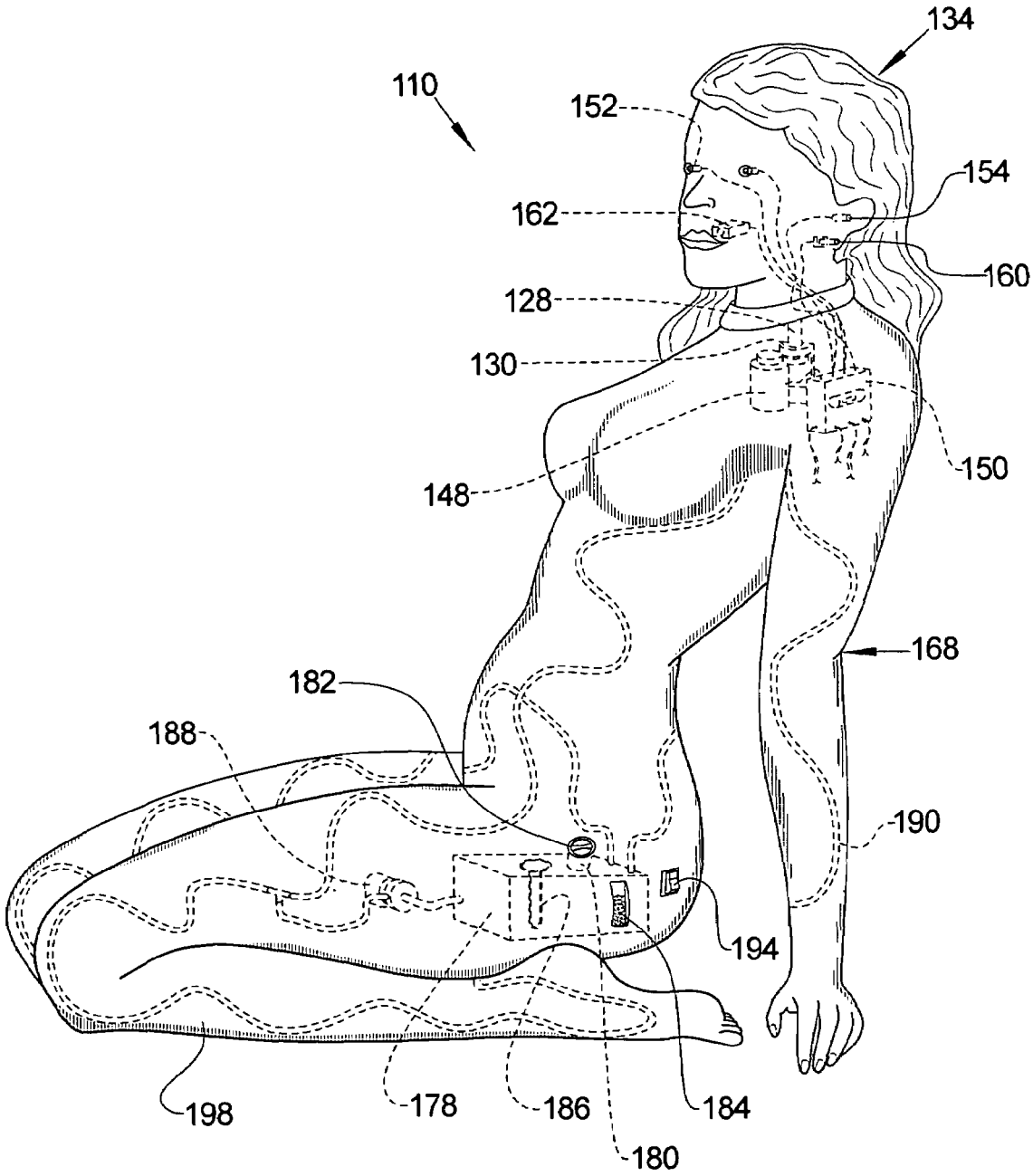
FIG. 5 is a perspective view of an alternate embodiment of the articulating companion doll of the present invention illustrating the internal workings.

As seen in FIG. 5, the articulating companion doll 110 may be full sized for either use in the patrol car, for home use, or other appropriate use. This doll 110, which is substantially similar to the doll of FIGS. 1-4 has legs 198 and may have only a subset of the components of the doll 10 of FIGS. 1-4 such as the illustrated neck bar 128, drive gear housing 130, second motor 148, controller 150, first sensor 152, second sensor 154, light sensor 160, voice box 162, body shell 168, reservoir 178, filler tube 180 with cap 182, heater element 186, pump 188, tubes 190, sight glass 184, on/off switch 194, head shell 134 that rotates, etc., that all operate in substantially similar fashion to the corresponding components of the doll 10 of FIGS. 1-4.

While the invention has been particularly shown and described with reference to an embodiment thereof, it will be appreciated by those skilled in the art that various changes in form and detail may be made without departing from the spirit and scope of the invention.

I claim:

1. A doll comprising:

a base member;

a base bar attached to the base member;

a standard extending upwardly from the base bar;

a cross bar attached to the standard;

a first bar rotatably attached to a medial point of the cross bar;

a first shell in the representation of a human head attached to and covering the first bar;

a second bar rotatably attached to an end of the cross bar;

a third bar rotatably attached to the second bar;

a reservoir attached to the base member;

a pump fluid flow connected to the reservoir;

a second shell in the representation of at least a portion of a human body covering the base bar, the standard, the cross bar, the second bar, the third bar, the reservoir, and the pump such that the second shell attaches to the first shell and to the base member and such that the cross bar is received within a representation of shoulders of the human body of the second shell, the second bar is received within a representation of an upper arm of the human body of the second shell and the third bar is received within a representation of a lower arm of the human body of the second shell;

a tube fluid flow connected with the pump and with the reservoir and passing through the second shell;

wherein the head, the upper arm and the lower arm are each able to articulate and wherein the pump draws a fluid from the reservoir and pumps the fluid through the tube and thereafter the fluid returns to the reservoir.

2. The doll as in claim 1 further comprising a first motion sensor disposed within a representation of an eye of the head of the first shell such that the head articulates in response to a motion stimuli received by the first motion sensor.

3. The doll as in claim 2 further comprising a voice box disposed within the first shell such that the voice box produces a sound whenever the head articulates.

4. The doll as in claim 2 further comprising a second motion sensor disposed within the head of the first shell proximate a representation of an ear such that the head also articulates in response to a motion stimuli received by the second motion sensor.

5. The doll as in claim 4 further comprising a light sensor disposed within the head of the first shell proximate the representation of the ear such that the head also articulates in response to a light stimuli received by the light sensor.

6. The doll as in claim 5 further comprising a voice box disposed within the first shell such that the voice box produces a sound whenever the head articulates.

7. The doll as in claim 1 further comprising:

a first sub-frame attached to the third bar;

a second sub-frame rotatably attached to the first sub-frame; and wherein the second sub-frame is capable of articulating with respect to the first sub-frame.

8. The doll as in claim 1 further comprising a heater element disposed within the reservoir in order to heat the fluid held within the reservoir.

9. The doll as in claim 8 further comprising a sight glass disposed within the reservoir and protruding through the second shell.

10. A doll comprising:

a base member;

a frame structure attached to the base, the frame capable of articulation a first shell in the representation of a human head attached to and covering a first portion of the frame structure;

a reservoir attached to the base member;

a pump fluid flow connected to the reservoir;

a second shell in the representation of at least a portion of a human body attached to and covering a second portion of the frame structure, the reservoir, and the pump such that the second shell attaches to the first shell and to the base member;

a tube fluid flow connected with the pump and with the reservoir and passing through the second shell;

wherein the head, a representation of an upper arm of the second shell, a representation of a lower arm of the second shell, and a representation of a hand of the second shell are each able to articulate and wherein the pump draws a fluid from the reservoir and pumps the fluid through the tube and thereafter the fluid returns to the reservoir.

11. The doll as in claim 10 further comprising a first motion sensor disposed within a representation of an eye of the head of the first shell such that the head articulates in response to a motion stimuli received by the first motion sensor.

12. The doll as in claim 11 further comprising a voice box disposed within the first shell such that the voice box produces a sound whenever the head articulates.

13. The doll as in claim 11 further comprising a second motion sensor disposed within the head of the first shell proximate a representation of an ear such that the head also articulates in response to a motion stimuli received by the second motion sensor.

14. The doll as in claim 13 further comprising a light sensor disposed within the head of the first shell proximate the representation of the ear such that the head also articulates in response to a light stimuli received by the light sensor.

15. The doll as in claim 14 further comprising a voice box disposed within the first shell such that the voice box produces a sound whenever the head articulates.

16. The doll as in claim 10 further comprising a heater element disposed within the reservoir in order to heat the fluid held within the reservoir.

17. The doll as in claim 16 further comprising a sight glass disposed within the reservoir and protruding through the second shell.

* * * * *